United States Patent [19]

Romblom et al.

[11] 4,399,799

[45] Aug. 23, 1983

[54] ENGINE CONTROL SUITABLE FOR EXHAUST GAS RECIRCULATION CONTROL

[75] Inventors: Edward R. Romblom, DeWitt; Arthur R. Sundeen, Lansing, both of Mich.

[73] Assignee: General Motors Corporation, Detroit, Mich.

[21] Appl. No.: 342,729

[22] Filed: Jan. 26, 1982

[51] Int. Cl.[3] ..... F02M 25/06

[52] U.S. Cl. ..... 123/571; 123/488; 123/573; 123/625; 123/569

[58] Field of Search ..... 123/571, 568, 488, 573, 123/625, 569

[56] References Cited

U.S. PATENT DOCUMENTS

| | | | |
|---|---|---|---|
| 4,033,309 | 7/1977 | Hayashi et al. | 123/568 |
| 4,057,043 | 11/1977 | Haraba et al. | 123/568 |
| 4,071,006 | 1/1978 | Haraba | 123/568 |
| 4,161,929 | 7/1979 | Nohira et al. | 123/571 |
| 4,224,912 | 9/1980 | Tanaka | 123/571 |
| 4,226,222 | 10/1980 | Kohama et al. | 123/571 X |
| 4,257,382 | 3/1981 | Matsui et al. | 123/571 |

*Primary Examiner*—Wendell E. Burns
*Attorney, Agent, or Firm*—C. K. Veenstra

[57] ABSTRACT

An exhaust gas recirculation control valve is positioned by a diaphragm responsive to the difference between a control pressure and atmospheric pressure. The control pressure is adjusted so that its absolute value is maintained equal to a command which varies with engine operating conditions, whereby exhaust gas recirculation is reduced automatically upon a decrease in atmospheric pressure.

4 Claims, 1 Drawing Figure

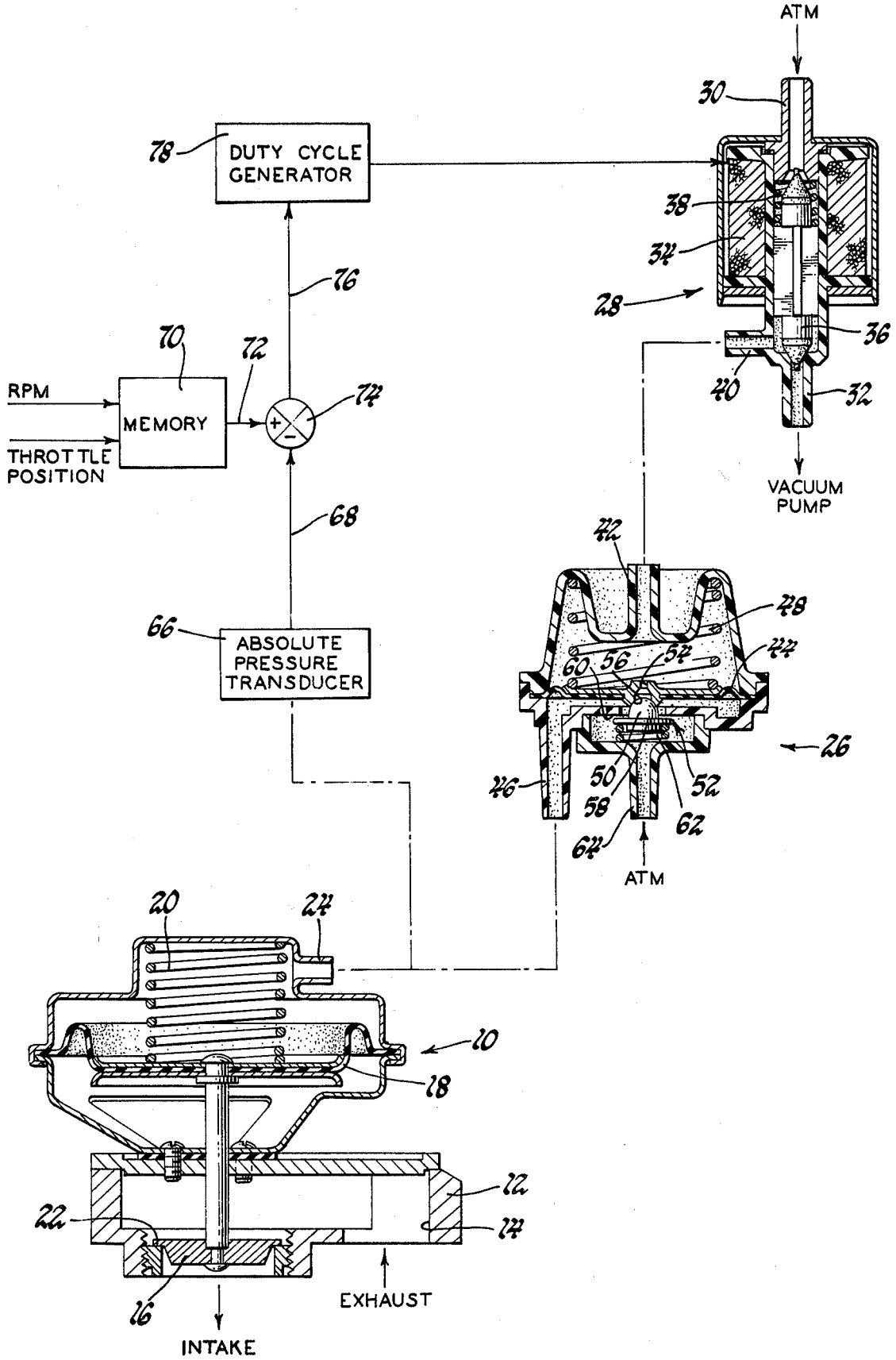
ATM
30
78
DUTY CYCLE GENERATOR
38
34
76
28
36
70
72
RPM
MEMORY
74
THROTTLE POSITION
40
32
VACUUM PUMP
68
42
66
ABSOLUTE PRESSURE TRANSDUCER
48
44
60
56
54
26
46
50
58
52
62
64
ATM
20
24
10
18
12
22
14
16
EXHAUST
INTAKE

ENGINE CONTROL SUITABLE FOR EXHAUST GAS RECIRCULATION CONTROL

TECHNICAL FIELD

This invention relates to a method and apparatus suitable for controlling exhaust gas recirculation which allows recirculation of exhaust gases to be adjusted automatically with a change in atmospheric pressure.

BACKGROUND

Recirculation of exhaust gases has been employed in automotive engines to inhibit the formation and emission of oxides of nitrogen. In general, it is desired to vary the proportion of exhaust gases which are recirculated in accordance with changes in engine operating conditions; for example, in a diesel engine it is desired to increase recirculation as the throttle reduces fuel flow, to increase recirculation with engine speed, and to reduce recirculation with a decrease in the ambient atmospheric pressure. The exhaust gas recirculation valve is frequently operated by a diaphragm responsive to a subatmospheric control pressure, and various electrical, pneumatic and mechanical devices have been employed to establish the desired control pressure.

SUMMARY OF THE INVENTION

This invention provides a novel engine control method and apparatus in which, when used for controlling exhaust gas recirculation (EGR), a diaphragm operated EGR valve is positioned in accordance with a control pressure in a manner that allows recirculation of exhaust gases to be reduced automatically in response to a decrease in the ambient atmospheric pressure.

To provide automatic control of exhaust gas recirculation with ambient pressure, as set forth herein, a diaphragm operated EGR valve is opened to permit recirculation of exhaust gases in accordance with the difference between atmospheric pressure and a control pressure. The absolute value of the control pressure is measured and compared with a command pressure signal which would effect the recirculation desired for the then existing engine operating conditions, and the control pressure is adjusted to equal the command pressure signal. As the command pressure signal is varied with changes in engine speed, throttle position, and/or other engine operating conditions, the control pressure is changed to effect recirculation of the desired proportion of engine exhaust gases. Should the ambient atmospheric pressure change, as with a change in altitude, for example, the absolute value of the command pressure signal and thus of the control pressure would not change; however, the difference between atmospheric pressure and the control pressure would change, and the diaphragm operated EGR valve is thereby automatically repositioned to adjust the proportion of exhaust gases which are recirculated.

The details as well as other features and advantages of this invention are set forth in the remainder of the specification and are evident from the accompanying drawing.

SUMMARY OF THE DRAWING

The sole FIGURE of the drawing is a schematic view of a diesel engine exhaust gas recirculation control system which operates in accordance with the invention.

BEST MODE FOR CARRYING OUT THE INVENTION

Referring to the drawing, a conventional exhaust gas recirculation (EGR) control valve assembly 10 has a valve body 12 defining a portion of a recirculation passage 14 for recirculating exhaust gases from the engine exhaust passage to the engine intake passage. An EGR valve pintle 16 is positioned in passage 14 by a diaphragm 18 and is biased by a spring 20 to engage a valve seat 22. When a subatmospheric control pressure is applied to a fitting 24, diaphragm 18 responds to the difference between the control pressure above diaphragm 18 and the ambient atmospheric pressure below diaphragm 18 and lifts EGR valve pintle 16 against the bias of spring 20 to permit recirculation of exhaust gases through passage 14.

The control pressure is applied to fitting 24 by a conventional small vacuum follower unit 26 which is connected to a conventional duty cycle modulated solenoid unit 28. Solenoid unit 28 has a fitting 30 for admitting air at ambient atmospheric pressure and a fitting 32 connected to a source of subatmospheric pressure such as the vacuum pump on a diesel engine. Within solenoid valve unit 28, a coil 34 is energized according to a variable duty cycle to reciprocate an electromagnetically responsive valve member 36 against the bias of a spring 38. When coil 34 is energized, valve member 36 is pulled back against spring 38 to open subatmospheric pressure fitting 32 and close atmospheric pressure fitting 30, and when coil 34 is deenergized, spring 38 pushes valve member 36 to open atmospheric fitting 30 and close subatmospheric fitting 32. As the duty cycle of coil 34 is increased, valve member 36 spends a lesser proportion of time obstructing subatmospheric fitting 32 and a greater proportion of time obstructing atmospheric fitting 30; conversely, as the duty cycle of coil 34 is decreased, valve member 36 spends a lesser proportion of the time obstructing atmospheric fitting 30 and a greater proportion of the time obstructing subatmospheric fitting 32. Solenoid valve unit 28 thereby generates an operating pressure in a fitting 40, the absolute value of which decreases with an increase in the duty cycle of coil 34. When the duty cycle is increased, the reduced time available for air flow through atmospheric fitting 30 results in a decrease in the absolute value of the operating pressure in fitting 40; when the duty cycle is decreased, the reduced time available for flow through subatmospheric fitting 32 results in an increase in the absolute value of the operating pressure in fitting 40.

A fitting 42 on vacuum follower unit 26 receives the operating pressure from fitting 40 and applies it to the upper surface of a diaphragm 44. The lower surface of diaphragm 44 is exposed to the control pressure applied through a fitting 46 to fitting 24 on EGR valve assembly 10. When the force created by the control pressure below diaphragm 44 exceeds the force created by the operating pressure above diaphragm 44 and the bias of a spring 48, diaphragm 44 lifts away from the top 50 of a valve member 52; an orifice 54 through diaphragm 44 is then exposed, allowing the operating pressure above diaphragm 44 to reduce the control pressure below diaphragm 44. When the force created by the operating pressure above diaphragm 44 and the bias of spring 48 exceeds the force created by the control pressure below diaphragm 44, diaphragm 44 pushes a seat 56 surrounding orifice 54 against the top 50 of valve member 52; the flange 58 of valve member 52 is then disengaged from an annular valve seat 60 against the bias of a spring 62, allowing air at atmospheric pressure to enter from a fitting 64 and increase the control pressure below diaphragm 44.

Thus it may be seen that vacuum follower unit 26 causes the control pressure applied to EGR valve assembly 10 to follow the operating pressure created by solenoid unit 28. As the duty cycle of solenoid unit 28 is decreased to increase the operating pressure, vacuum follower unit 26 admits air from fitting 64 to increase the control pressure. As the duty cycle of solenoid unit 28 is increased to decrease the operating pressure, orifice 54 in vacuum follower unit 26 is opened to reduce the control pressure. The control pressure thus follows the operating pressure and is offset from the operating pressure an amount determined primarily by the bias of spring 48.

A transducer 66 measures the absolute value of the control pressure applied to EGR valve assembly 10 and generates a control pressure signal on line 68 which is indicative thereof. A conventional memory unit 70 generates a command pressure signal on line 72 indicative of the control pressure desired for the then existing combination of engine speed (RPM), throttle position, and/or other engine operating conditions. The control pressure signal and the command pressure signal are compared at 74, and any deviation is directed on line 76 to a duty cycle generator 78 which energizes coil 34. As is conventional, duty cycle generator 78 has proportional and integral functions which decrease the duty cycle to increase the control pressure when the control pressure signal is less than the command pressure signal and which increase the duty cycle to reduce the control pressure when the control pressure signal is greater than the command pressure signal. This closed loop pressure regulation accordingly minimizes any deviation of the actual control pressure from the desired control pressure, and EGR valve assembly 10 is positioned to provide the recirculation of exhaust gases desired for the then existing engine operating conditions.

The ambient atmospheric pressure decreases substantially when the engine is operated at higher altitudes, and the proportion of engine exhaust gases which are recirculated should be decreased accordingly. Such is accomplished automatically in this system because transducer 66 measures the absolute value of the control pressure while EGR valve assembly 10 positions valve pintle 16 in accordance with the difference between the absolute value of the control pressure and the absolute value of the atmospheric pressure. Thus as the atmospheric pressure applying an upward force on the bottom of diaphragm 18 decreases, spring 20 urges valve pintle 16 toward its seat 22 to reduce recirculation of exhaust gases. Accordingly, with this invention exhaust gas recirculation is adjusted automatically with changes in ambient atmospheric pressure, without any requirement for a separate transducer to measure the ambient atmospheric pressure.

The embodiments of the invention in which an exclusive property or privilege is claimed are defined as follows:

1. The method of controlling exhaust gas recirculation in an engine having a diaphragm operated valve opened to permit recirculation of exhaust gases in accordance with the difference between atmospheric pressure and a control pressure, said method comprising the steps of generating a control pressure signal indicative of said control pressure, generating a command pressure signal indicative of the control pressure desired for the then current engine operating conditions, comparing said signals to establish the deviation of said control pressure signal from said command pressure signal, and adjusting said control pressure to minimize said deviation, and wherein said control pressure signal is indicative of the absolute value of said control pressure and said command pressure signal is indicative of the absolute value of the desired control pressure, whereby the opening of said valve varies directly with atmospheric pressure for at least certain engine operating conditions and recirculation of exhaust gases is thereby adjusted automatically with a change in atmospheric pressure.

2. The method of controlling exhaust gas recirculation in an engine having a diaphragm operated valve opened to increase recirculation of exhaust gases with an increase in the difference between atmospheric pressure and a subatmospheric control pressure, said method comprising the steps of generating a control pressure signal indicative of said subatmospheric control pressure, generating a command pressure signal indicative of the subatmospheric control pressure desired for the then current engine operating conditions, comparing said signals to establish the deviation of said control pressure signal from said command pressure signal, and adjusting said subatmospheric control pressure to minimize said deviation, and wherein said control pressure signal is indicative of the absolute value of said subatmospheric control pressure and said command pressure signal is indicative of the absolute value of the desired control pressure, whereby the opening of said valve varies directly with atmospheric pressure for at least certain engine operating conditions and recirculation of exhaust gases is thereby reduced automatically with a decrease in atmospheric pressure.

3. A system for positioning a valve controlling exhaust gas recirculation in an engine and effective to automatically adjust the position of said valve to vary exhaust gas recirculation in accordance with changes in the absolute value of the ambient atmospheric pressure without measuring the absolute value of the ambient atmospheric pressure, said system comprising a closed loop pressure regulator including a unit for generating a control pressure, a transducer for measuring the value of the control pressure generated by said unit, and means responsive both to sensed engine operating conditions and to the measured value of the control pressure for causing said unit to establish a control pressure having the value desired for the sensed engine operating conditions, and a diaphragm subjected on one side to the control pressure and on the opposite side to the ambient atmospheric pressure and connected to said valve for positioning said valve in accordance with the difference between the control pressure and the ambient atmospheric pressure, whereby said valve is positioned to permit exhaust gas recirculation as desired for the sensed engine operating conditions, and wherein said transducer measures the absolute value of the control pressure and said means causes said unit to establish a control pressure having the absolute value desired for the sensed engine operating conditions, whereby the position of said valve is automatically adjusted to vary exhaust gas recirculation in accordance with changes in the absolute value of the ambient atmospheric pressure.

4. A system for positioning an engine control member and effective to automatically adjust the position of said member in response to changes in the absolute value of the ambient atmospheric pressure without measuring the absolute value of the ambient atmospheric pressure, said system comprising a closed loop pressure regulator including a unit for generating a control pressure, a transducer for measuring the value of the control pressure generated by said unit, and means responsive both to sensed engine operating conditions and to the measured value of the control pressure for causing said unit to establish a control pressure having the value desired for the sensed engine operating conditions, and a diaphragm subjected on one side to the control pressure and on the opposite side to the ambient atmospheric pressure and connected to said member for positioning said member in accordance with the difference between the control pressure and the ambient atmospheric pressure, whereby said member is positioned as desired for the sensed engine operating conditions, and wherein said transducer measures the absolute value of the control pressure and said means causes said unit to establish a control pressure having the absolute value desired for the sensed engine operating conditions, whereby the position of said member is automatically adjusted in response to changes in the absolute value of the ambient atmospheric pressure.

* * * * *